US005310977A

United States Patent [19]

Stenkamp et al.

[11] Patent Number: 5,310,977

[45] Date of Patent: May 10, 1994

[54] CONFIGURED MICROWAVE SUSCEPTOR

[75] Inventors: Victoria S. Stenkamp, Maplewood, Minn.; Curtis L. Larson, Hudson, Wis.; Pierre H. LePere, Cottage Grove, Minn.

[73] Assignee: Minnesota Mining and Manufacturing Company, St. Paul, Minn.

[21] Appl. No.: 980,427

[22] Filed: Nov. 23, 1992

Related U.S. Application Data

[63] Continuation of Ser. No. 649,212, Jan. 25, 1991, abandoned, which is a continuation of Ser. No. 306,530, Feb. 3, 1989, abandoned.

[51] Int. Cl.[5] ..... H05B 6/80

[52] U.S. Cl. ..... 219/730; 219/727; 426/107; 426/234; 426/243; 99/DIG. 14

[58] Field of Search ..... 219/10.55 E, 10.55 F, 219/10.55 M, 10.55 R; 426/107, 109, 111, 112, 113, 114, 241, 234, 243; 99/DIG. 14, 451, 425, 444, 445, 446

[56] References Cited

U.S. PATENT DOCUMENTS

| | | | |
|---|---|---|---|
| 3,946,187 | 3/1976 | MacMaster et al. | 219/10.55 E |
| 3,994,212 | 11/1976 | Wong | 219/10.55 E X |
| 4,023,174 | 5/1977 | Wright . | |
| 4,121,510 | 10/1978 | Frederick | 99/DIG. 14 |
| 4,140,889 | 2/1979 | Mason, Jr. et al. | 219/10.55 E |
| 4,186,217 | 1/1980 | Tchack | 99/446 X |
| 4,190,757 | 2/1980 | Turpin et al. | 219/10.55 E |
| 4,230,924 | 10/1980 | Brastad et al. | 219/10.55 E |
| 4,260,060 | 4/1981 | Faller . | |
| 4,267,420 | 5/1981 | Brastad | 219/10.55 E |
| 4,268,738 | 5/1981 | Flault, Jr. et al. | 219/10.55 E |
| 4,362,917 | 12/1982 | Freedman et al. | 219/10.55 E |
| 4,398,077 | 8/1983 | Freedman et al. | 219/10.55 E |
| 4,404,241 | 9/1983 | Mueller et al. | 426/113 |
| 4,416,906 | 11/1983 | Watkins | 426/243 |
| 4,416,907 | 11/1983 | Watkins | 426/243 |
| 4,425,368 | 1/1984 | Watkins | 426/107 |
| 4,428,281 | 1/1984 | Miller | 99/445 |
| 4,450,180 | 5/1984 | Watkins | 426/243 |
| 4,548,826 | 10/1985 | Watkins | 426/394 |
| 4,553,010 | 11/1985 | Bohrer et al. | 219/10.55 E |
| 4,555,605 | 11/1985 | Brown et al. | 219/10.55 E |
| 4,567,341 | 1/1986 | Brown | 219/10.55 E |
| 4,590,349 | 5/1986 | Brown et al. | 219/10.55 E |
| 4,592,914 | 6/1986 | Kuchenbecker | 219/10.55 E |
| 4,594,492 | 6/1986 | Maroszek | 219/10.55 E |
| 4,612,431 | 9/1986 | Brown et al. | 219/10.55 E |
| 4,626,641 | 12/1986 | Brown | 219/10.55 E |
| 4,641,005 | 2/1987 | Seiferth | 219/10.55 E |
| 4,642,434 | 2/1987 | Cox et al. | 219/10.55 E |
| 4,661,671 | 4/1987 | Maroszek | 219/10.55 E |
| 4,698,472 | 10/1987 | Cox et al. | 219/10.55 E |
| 4,703,148 | 10/1987 | Mikulski et al. | 219/10.55 E |
| 4,705,929 | 11/1987 | Atkinson | 219/10.55 E |
| 4,735,513 | 4/1988 | Watkins et al. | 219/10.55 E |
| 4,742,203 | 5/1988 | Brown et al. | 219/10.55 E |
| 4,745,249 | 5/1988 | Daniels . | |
| 4,775,771 | 10/1988 | Pawlowski et al. | 219/10.55 E |
| 4,777,053 | 10/1988 | Tobelmann et al. | 219/10.55 E |
| 4,780,587 | 10/1988 | Brown | 219/10.55 E |
| 4,794,005 | 12/1988 | Swiontek | 219/10.55 E X |
| 4,820,893 | 4/1989 | Mode | 219/10.55 E |
| 4,825,025 | 4/1989 | Seiferth | 219/10.55 E |
| 4,841,112 | 6/1989 | Peleg | 219/10.55 E |
| 4,943,439 | 7/1990 | Andreas et al. | 219/10.55 E |
| 5,053,594 | 10/1991 | Thota et al. | 219/10.55 E |
| 5,075,526 | 12/1991 | Sklenak et al. | 219/10.55 E |

FOREIGN PATENT DOCUMENTS

| | | | |
|---|---|---|---|
| 62-158929 | 7/1987 | Japan | 219/10.55 E |

OTHER PUBLICATIONS

"Microcrisp Wrap Browns, Crisps Pies in Minutes", *World Food and Drink Report*, Mar. 23, 1989.

"The Role of Packaging in Achieving Browning and Crisping" Mar. 9, 1988, by Scott William Middleton, 24 pages.

*Primary Examiner*—Philip H. Leung

*Attorney, Agent, or Firm*—Gary L. Griswold; Walter N. Kirn; Peter L. Olson

[57] ABSTRACT

A microwave susceptor having projections such as linear ridges which define circulation channels such as linear grooves. The susceptor may include apertures at the ridge apexes and the groove nadirs for allowing food secretions such as grease and steam, to pass through the susceptor. A strut may be releasably coupled to the susceptor for increasing the structural integrity of the susceptor.

3 Claims, 4 Drawing Sheets

FIG. 4
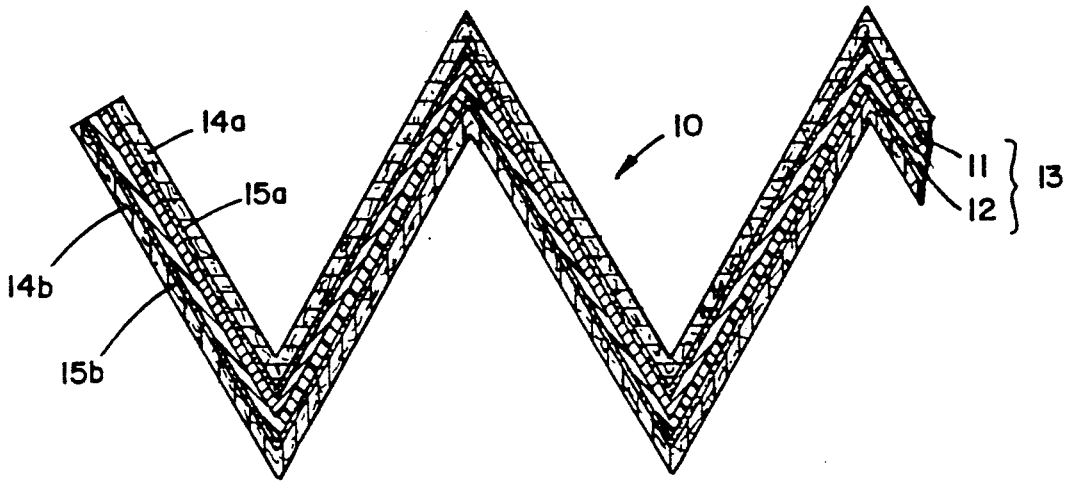
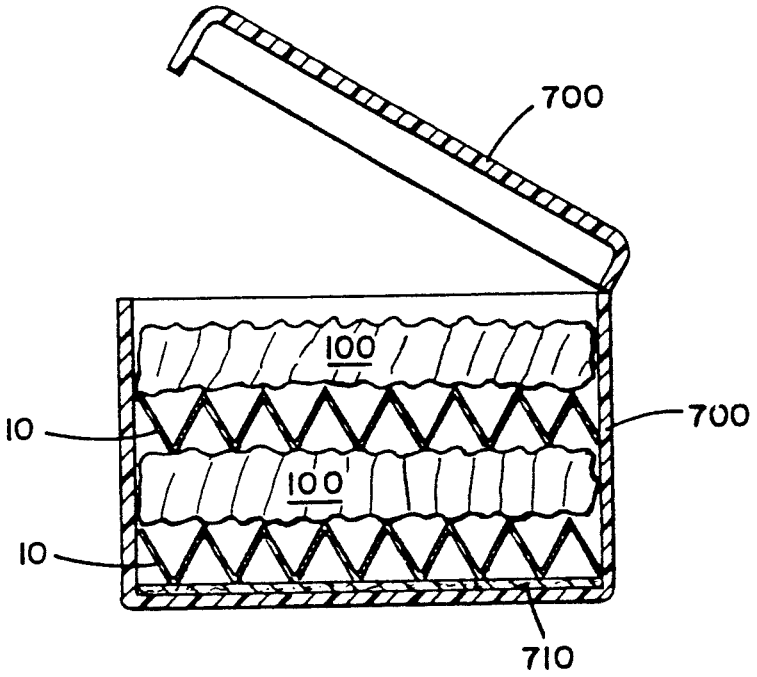
FIG. 7

CONFIGURED MICROWAVE SUSCEPTOR

This is a continuation of the now abandoned application Ser. No. 07/649,212, filed Jan. 25, 1991, which is a continuation of the now abandoned application Ser. No. 07/306,530, filed Feb. 3, 1989.

FIELD OF THE INVENTION

Broadly, the invention relates to microwave active cookware. Specifically, the invention relates to disposable microwave interactive substrates, such as microwave susceptors, for converting microwave energy to thermal energy such as is necessary for achieving the browning and/or crisping of foods.

BACKGROUND OF THE INVENTION

Microwave ovens operate on the principle that foods respond directly to microwave energy by converting the microwave to thermal energy. Microwave ovens are based upon this simple principle and, in their most basic operational form, are nothing more than a magnetron for converting electrical energy to microwave energy and a means for directing and distributing the microwave energy to an oven cavity. Microwave ovens have become a common, nearly standard appliance in most residential homes as well as most commercial and institutional businesses. The popularity of microwave cooking is attributable mainly to the high speed with which cooking occurs and its ability to reheat foods without causing additional browning/crispen of the food.

A microwave accessory, known as a microwave susceptor, is commonly employed when microwaving foods which need to reach a surface temperature in excess of the surface temperature attainable by unassisted microwaving. A microwave susceptor assists in the microwave cooking of foods by absorbing microwave energy, converting the absorbed microwave energy to thermal energy, and then transferring the thermal energy to the food by means of conduction and/or convection. Susceptors permit microwave ovens to cook many foods once thought to require a conventional oven such as popcorn and pizza, However, one group of foods where susceptors did not perform well was with respect to those foods requiring browning and crisping, such as potatoes, meats and breaded foods. It was believed that microwave energy was able to cook such foods so rapidly by direct absorption that the susceptor did not have an opportunity to brown and/or crispen the food before cooking was complete.

Attempts to increase the amount of heat generated by a susceptor which is available to brown/crispen a food item have met with limited success. With respect to the typical vapor deposited microwave heater film, increasing the useful heat generating capacity of a susceptor by increasing the thickness of the heat generating layer is generally limited by the phenomena that absorptive layers of greater than a specified thickness, based upon the particular material involved as well as various other factors, tend to cause arcing. Likewise, increasing the useful heat generating capacity of a susceptor by increasing the surface area of the susceptor is limited by the requirement that a susceptor must be in direct contact with or directly underneath the food item to be effective.

To compensate for the differences in cooking rates between direct absorption, of microwave energy and transfer of thermal energy by conduction and/or convection, typical microwave packages which employ a susceptor often include a microwave shield, such as a layer of aluminum foil, to control the amount of microwave energy directly reaching the food within the package. By slowing down cooking of the food from the absorption of microwave energy, the susceptor is given sufficient time to brown/crispen the food. In addition, since conduction transfers heat quicker than convection, microwave packages typically configure the susceptor to maximize direct contact between food and susceptor to speed heat transfer from the susceptor to the food.

The use of microwave shielding, while beneficial in many respects, does have its drawbacks. Two major drawbacks associated with the utilization of microwave shielding are that (i) it slows down microwave heating and can significantly increase cooking time, and (ii) can damage the oven and/or cause burning due to arcing.

Likewise the use of direct contact between food and susceptor to maximize conductive heat transfer is beneficial in many respects, but also has drawbacks. One major drawback associated with direct contact between food and susceptor is that typical susceptors are nonporous and will trap food secretions such as grease and steam between the food and the susceptor and thereby saturate the food with such secretions and reduce conductive heat transfer.

Accordingly, a need exists for a microwave susceptor which is constructed, configured and arranged to (i) increase the speed with which the outer surface of food can be browned/crisped by conduction and/or convection, and (ii) provide for the release of exudate from between food and susceptor so as to prevent the food from becoming saturated with such exudate and prevent the accompanying reduction in conductive heat transfer.

SUMMARY OF THE INVENTION

The invention is a microwave accessory, commonly known as a microwave susceptor, having projections which define circulation channels. The susceptor is preferably configured to define alternating linear ridges (projections) and grooves (circulation channels). In use, a food item is supportably retained upon the susceptor by the projections so that secretions from the food item, such as grease and steam, can flow into the circulation channels and out from between susceptor and food.

Such a susceptor design has several advantages not found in other susceptor configurations including (i) removal of exudate from between susceptor and food, (ii) increasing the effective surface area of the susceptor in effective thermal communication with the food, and (iii) in preferred embodiments, allowing a single susceptor embodiment to be custom configured at the point of use by simply compressing or expanding the susceptor.

In a preferred embodiment of the susceptor, groove nadirs and/or the ridge apexes include a plurality of apertures of the susceptor for allowing food exudate to pass through the susceptor.

The microwave susceptor may be conveniently manufactured by (i) laminating a microwave interactive layer to at least one layer of a configurational, structural, dielectric substrate; and (ii) shaping the laminate to form projections which define circulation channels.

As utilized herein, the term "circulation channel" refers to channels or grooves which permit air to circulate around a food item supported over at least a portion of the channel so as to remove fluids, such as food secretions, from between the food and the substrate supporting the food.

As utilized herein, the term "configurational" refers to materials which may be bent, folded or otherwise shaped.

As utilized herein, the term "definitive apexes and nadirs" refers to apexes and nadirs which are precisely defined, such as those defined by a sharp and substantially instantaneous change between a rapidly ascending surface and a rapidly descending surface.

As utilized herein, the term "dielectric material" refers to materials which are substantially microwave transparent and allow the transmission of microwave energy therethrough.

As utilized herein, the term "fluid" refers to substances which tend to assume the shape of their container and include both gasses and liquids.

As utilized herein, the term "microwave accessory" refers to equipment which is not essential to the functioning of a basic microwave oven but is a helpful addition or supplement thereto.

As utilized herein, the term "microwave interactive" refers to materials which absorb and/or reflect a substantial proportion of the microwave energy striking the material. "Microwave interactive" is the antithesis of "microwave transparent".

As utilized herein, the term "microwave shield" refers to microwave reflective materials which can be configured about a food item so as to reduce the amount of microwave energy directly transmitted to the food item.

As utilized herein, the term "microwave transparent" refers to materials which allow microwaves to be transmitted therethrough without a substantial alteration in the intensity or direction of the microwaves. "Microwave transparent" is the antithesis of "microwave interactive".

As utilized herein, the term "pleated" and "fluted" refer to the general configuration achieved by folding something back upon itself in an accordion-like fashion.

As utilized herein, the term "susceptor" refers to substrates which include a layer of microwave interactive material capable of absorbing microwave energy and converting the microwave energy to sensible heat.

As utilized herein, the term "susceptor height" refers to the linear distance between the plane defined by the groove nadirs and the plane defined by the peak apexes.

BRIEF DESCRIPTION OF THE DRAWINGS

FIG. 4 is an expanded cross-sectional side view of a portion of the invention depicted in FIG. 2 taken along lines 4—4.

FIG. 7 is a side view of a microwavable package containing food items and the invention as depicted in FIG. 1.

DETAILED DESCRIPTION OF THE INVENTION INCLUDING A BEST MODE

Figure 1:
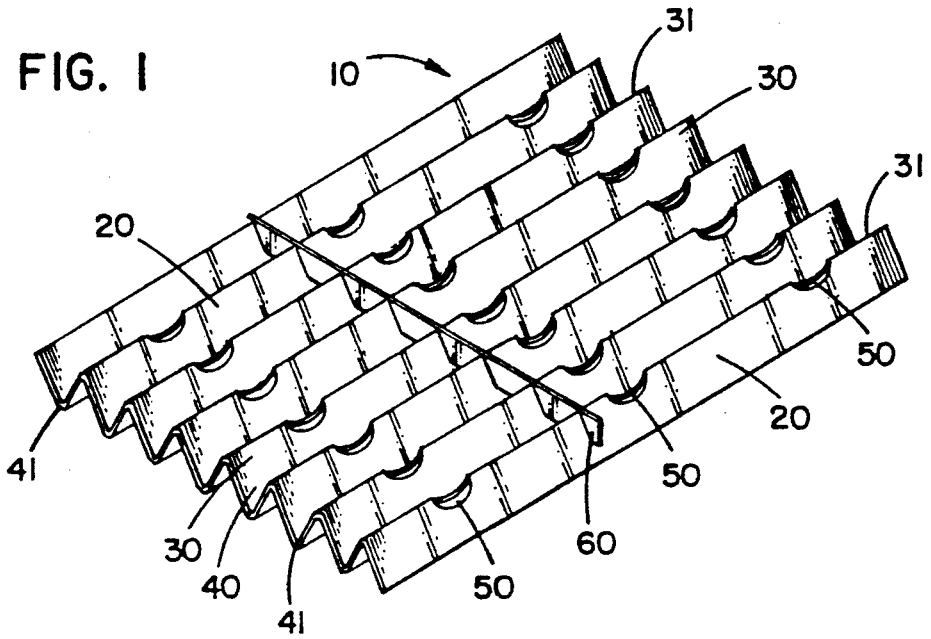
FIG. 1 is a perspective view of a first embodiment of the invention.
Figure 2:
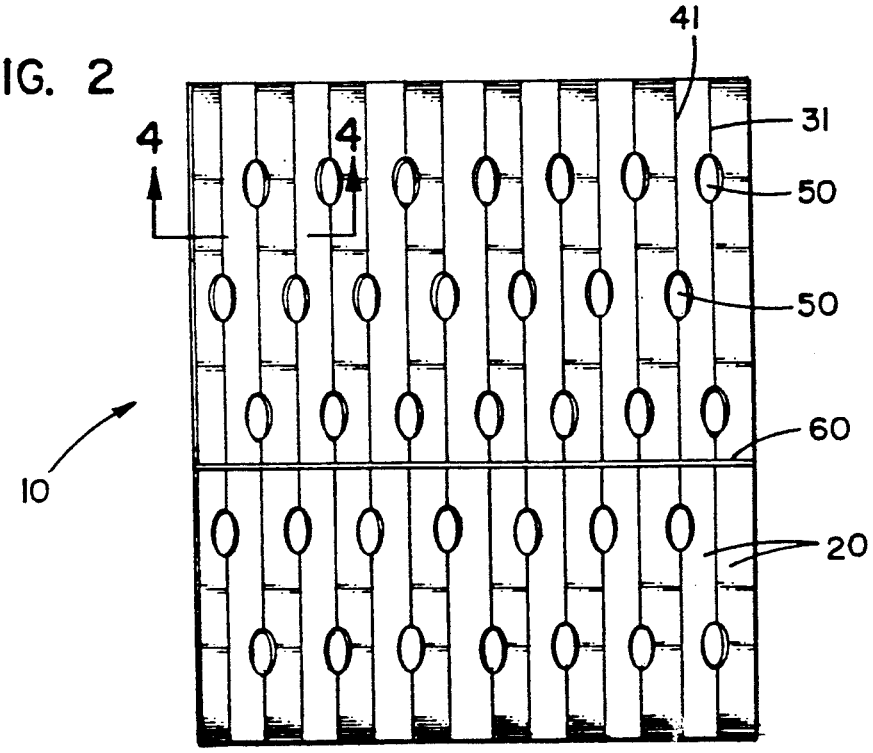
FIG. 2 is a top view of the invention as depicted in FIG. 1.
Figure 3:
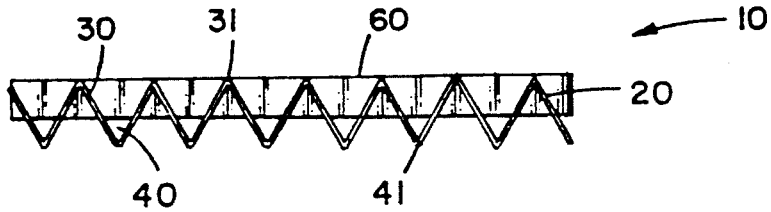
FIG. 3 is a side view of the invention as depicted in FIG. 1.
Figure 5:
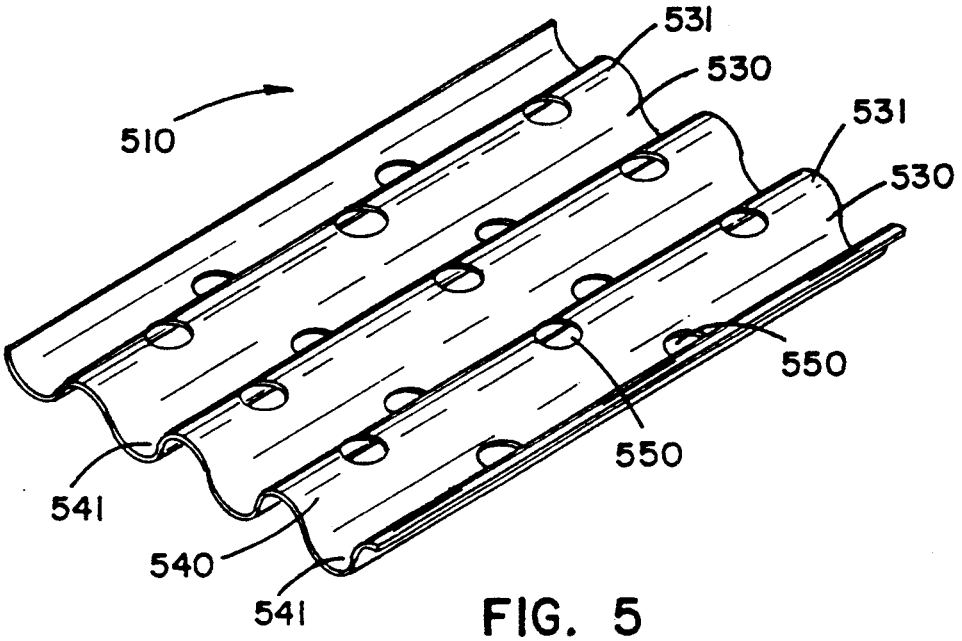
FIG. 5 is a perspective view of a second embodiment of the invention.
Figure 6:
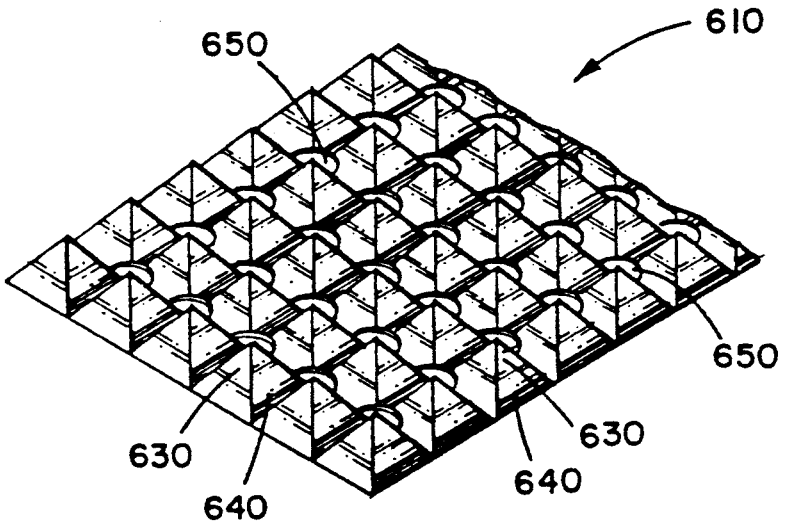
FIG. 6 is a perspective view of a third embodiment of the invention.
Figure 8:
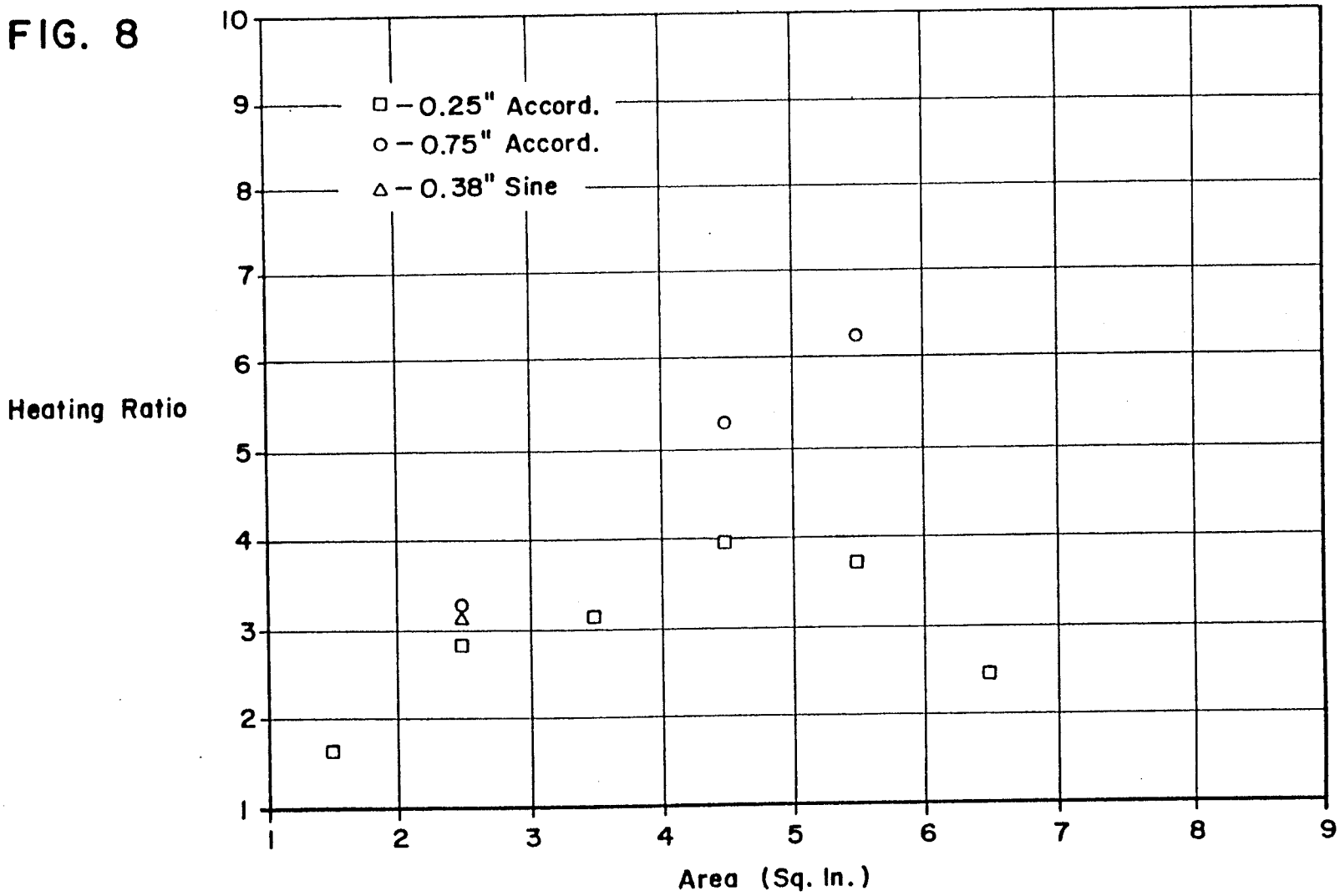
FIG. 8 is a graphical depiction of heat ratio vs. susceptor area for various face sizes and susceptor configurations.

Referring to FIG. One, there is illustrated a first embodiment of the microwave susceptor 10 of this invention. The susceptor 10 is fluted or pleated to form alternating linear ridges 30 and grooves 40 having definitive ridge apexes 31 and groove nadirs 41. The corrugated susceptor 10 can support a food item 100 upon the ridge apexes 31 so that food exudate, such as grease and steam, can flow away from the food item 100 through grooves 40. Food items 100 microwaved on susceptor 10 do not become saturated with grease, oil and/or water because such secretions are vented from between the susceptor 10 and the food 100. Such a configuration also possesses the beneficial attribute of increasing the amount of heat which can be generated from a fixed planar space such that higher temperatures can be achieved under a food item which occupies a given planar space. In addition, the pleated configuration also possesses the beneficial attribute of allowing the susceptor 10 to be customized at the point of use by simply compressing or expanding the pleats. Within limits, discussed infra, compressing increases the heat generation capacity of the susceptor while expanding decreases the heat generation capacity of the susceptor.

Susceptor 10 may be provided in flat sheets with scored fold lines positioned for producing the pleated susceptor 10 by folding the sheet in pleated fashion along the fold lines.

Susceptor 10 preferably includes apertures 50 through faces 20 for allowing fluids, such as grease and steam, to pass through the susceptor 10. At least one aperture 50 should be located at the nadir 41 of each groove 40 to allow liquid exudate, such as grease, to flow through aperture 50 and out from between food item 100 and susceptor 10. The number and size of apertures should be limited to maintain the structural integrity of the susceptor 10 and maximize the susceptor surface area available for converting microwave energy to thermal energy, the number and size of apertures 50 are preferably limited to those necessary to achieve the desired exudate removal. Apertures 50 may also be made through ridge apexes 31 for reducing the area of direct contact between susceptor 10 and food item 100 and thereby reducing the potential for exudate to become trapped between food 100 and susceptor 10. Apertures 50 are preferably about 0.2 to 1 cm and spaced about 1 to 10 cm, preferably about 3 to 5 cm, apart.

The incorporation of apertures 50 at both the groove nadirs 41 and ridge apexes 31 of susceptor 10 makes the susceptor 10 symmetrical and allows susceptor 10 to be employed in either an upright or inverted position without loss of performance.

Strut 60 may be incorporated into susceptor 10 transverse to linear ridges 30 and grooves 40 for increasing the structural integrity of susceptor 10. Strut 60 may be made from any suitable material capable of providing the necessary structural integrity including paper, paperboard, susceptor laminate, plastics, and the like. Strut 60 preferably extends only partially into groove 40 so that grooves 40 remain continuous through the susceptor 10. Strut 60 may be conveniently coupled to susceptor 10 by linearly slicing through ridges 30 and wedging strut 60 into the slices until the top of strut 60 is flush with ridge apexes 31. Other means for increasing the structural integrity of susceptor 10 may also be employed including (i) connecting pleats at the groove nadirs 41 with adhesive tape (not shown), (ii) cutting and folding dog ear cuts (not shown) into the faces 20 at the groove nadirs 41, etc.

Referring to FIG. Four, susceptor 10 is constructed of a microwave absorbing layer 11 bonded to a support layer 12 to form a microwave heating film 13, and then sandwiched between layers of configurational, structural dielectric material 14*a* and 14*b* adhesively bonded to heating film 13 by adhesive 15.

Microwave energy absorbing layer 11 can be formed from a layer of electrically conductive material. The layer of conductive material can be made of a single metal, a mixture of metals, an oxide of a metal, a mixture of oxides of metals, a dispersion of conductive metallic or nonmetallic materials in a binder, or any combination of the foregoing. Metals that are suitable for the conductive layer include aluminum, iron, tin, tungsten, nickel, stainless steel, titanium, magnesium, copper, and chromium. Metal oxides that are suitable for use in the conductive layer include aluminum oxide, iron oxide, and tin oxide. Dispersions that are suitable for use include carbon black, graphite, powdered metals, and metal whiskers. The conductive layer 11 can be applied to the support layer 12 by means of such processes as casting, evaporative vacuum deposition, sputtering, ion plating, and electroplating.

Microwave energy absorbing layer 11 must, in certain embodiments, be sufficiently thin to prevent arcing, but it must also be sufficiently thick to absorb sufficient microwave energy for its intended purpose. When formed from an electrically conductive material, the thickness of microwave energy absorbing layer 11 can vary from 10 to 1000 Angstroms; for deposited metals; 200 to 2000 Angstroms; for metal/metal oxide deposits; and 0.1 to 25 mils for conductive dispersions. However, it is preferred that the resistivity of the conductive layer be uniform over its surface and be greater than about 30 ohms per square in order to prevent arcing or the development of concentrated hot spots which could cause excessive scorching, burning, or melting of the package or its contents, alarm the user, or damage the microwave heating apparatus.

The resistivity at which arcing occurs can vary with the material of the conductive layer. For example, vapor deposited aluminum has been observed to arc at resistivities less than 30 ohms per square, vapor deposited stainless steel has been observed to arc at resistivities less than 250 ohms per square, uniform dispersions have been observed to arc at resistivities less than 100 ohms per square, nonuniform dispersions have been observed to arc at overall resistivities greater than several hundred ohms per square.

A support layer 12, employed when microwave absorbing layer 11 is a vapor deposited film, provides support to microwave energy absorbing layer 11 and, in certain embodiments, can act as a barrier for microwave energy absorbing layer 11, to protect it from coming into contact with the food 100 or food exudate. Support layer 12 can be made of plastics capable of withstanding the thermal temperatures achieved during microwaving and is preferably made of a polymeric film, which can be oriented or unoriented. As used herein, "orient", "oriented", and the like means stretching or tensilizing a film after preparation thereof. Preparation is typically carried out by extrusion, casting, blowing, or the like. Materials that have been found to be useful in the present invention for support layer 12 include polyolefins, polyesters, polyamides, polyimides, polysulfones, polyether ketones, cellophanes, and combinations, e.g. blends and laminates, of the foregoing. Support layer 12 can also be made of paper and laminates comprising paper.

When microwave absorptive particles are dispersed in a binder and formed into a microwave susceptor 10, the microwave absorbing layer 11 and support layer 12 can be one and the same.

A variety of metallized films, commonly referred to as microwave heater films, are commercially available from a number of manufacturers including the Minnesota, Mining and Manufacturing Company of Saint Paul, Minn.

It is within the scope of this invention to provide a susceptor 10 consisting of only microwave absorptive layer 11 and support layer 12 wherein support layer 12 is selected to provide the necessary structural support. However, typical microwave heater films 13 do not have sufficient structural integrity to function as a susceptor 10 without additional support and are therefore preferably adhesively laminated to a configurational structural substrate 14. Structural substrate 14 provides sufficient structural integrity to the susceptor 10 to allow the susceptor 10 to be configured into the desired shape and retain that shape when subjected to a load. Structural substrate 14 can be selected to either absorb food exudate or act as a barrier to food exudate to prevent the food exudate from contacting the microwave absorbing layer 11.

Structural substrate 14 may be selected from any suitable materials capable of providing the necessary configurational structural integrity, including absorbent materials such, as kraft paper and solid bleached sulfite paperboard, and non-absorbent materials such as greaseproof paper. In the preferred embodiment, microwave heater film 13 is adhesively laminated between two structural layers 14*a* and 14*b* to provide thermal stability to the susceptor 10. Suitable laminating adhesives 15 include silicone, acrulate and vinyl acetate based adhesives. Specific examples of suitable adhesives include product code WA2546 and WA2417A adhesives available from Electromek Company of Carlstad, N.J.; Duracet 12 TM and Duracet 30 TM adhesives available from Franklin International of Columbus, Ohio; and Resyn® 33-9082 adhesive available from National Starch and Chemical Corporation of Bridgewater, N.J.

Susceptor 10 preferably has a substantially uniform height so that a food item 100 can rest substantially horizontally upon the ridge apexes 31 of susceptor 10 and be supported by all of the ridge apexes 31 underneath the food 100. It is also within the scope of this invention to provide a susceptor 10 with a gradually angled susceptor height which would cause a food item 100 to be slightly inclined, as well as susceptors 10 with random, nonuniform ridge height.

The surface area of susceptor 10 which should be used in a given container 700 is based upon a number of considerations including container size and shape; the size, type and configuration of the food being heated; the size, shape, number and configuration of openings in the container; the positioning of the susceptor 10 within the container 700; and the conversion efficiency of the particular microwave absorbing material 11 utilized. In any event, a sufficient amount of microwave interactive material should be provided in order to enable the susceptor 10 to heat the surface of the food to a temperature of at least about 100° C. and preferably within the range of about 150°-200° C., in order to achieve the desired browning/crispen of the food 100. In general a susceptor height of between about 0.1 to 5 cm, preferably about 0.2 to 2 cm, and a distance between ridge apexes 31 of about 0.1 to 5 cm, preferably 0.25 to 2 cm, achieves the desired results.

The heating ratio (defined in Example IX, infra) of susceptor 10 configured in accordance with the present invention increases with increasing frequency of alternating ridges 30 and grooves 40, but appears to reach a maximum when the distance between ridge apexes 31 is about 0.10 cm (i.e. an apex angle of about 10°). At an apex distance of less than about 0.10 cm the heating ratio of the susceptor 10 appears to decrease. While not intending to be limited thereby, it is believed that such observed decrease in the heating ratio is attributable to shadowing of areas on the susceptor 10 by other portions of the susceptor 10. Accordingly, based upon data achieved by testing susceptors 10 with 0.25 inch face 20 widths as set forth in Example IX, infra, it appears that by maintaining a distance of at least 0.10 cm (10° apex angle) and preferably 0.25 cm (15° apex angle) between ridge apexes 31 the undesired shadowing effect can be minimized. While not intending to be limited thereby, we also believe that the distance between ridge apexes 31 and the nearest groove nadir 41 (i.e. face width) can also influence the shadowing effect. However, the influence of face height upon the shadowing effect is believed to be so small at the face heights anticipated to be employed (generally less than about 5 cm and typically less than about 2 cm) that the influence exerted by face width upon the shadowing effect can be ignored.

To achieve the benefits resulting from the claimed configuration of susceptor 10, susceptor 10 must be capable of retaining its shape when microwaved with food item 100 resting upon the ridge apexes 31 thereof. For typical intended uses of susceptor 10, the susceptor 10 preferably has sufficient structural integrity to support a food item during microwaving which weighs up to about 3 g/cm$^2$. More specifically, susceptor 10 preferably has sufficient structural integrity to retain at least 80% of the susceptor's 10 original height directly under the load, during microwaving, when supporting a load of up to about 3 g/cm$^2$.

Referring to FIG. Five, the susceptor may also be sinusoidal in shape; forming alternating linear ridges 530 and grooves 540 having nondefinitive ridge apexes 531 and groove nadirs 541. Similarly to the pleated embodiment, sinusoidal susceptor 510 may also include apertures 550 through ridges 330 and grooves 540. Sinusoidal susceptor 510 may also include a strut (not shown) such as employed with pleated susceptor 10. Sinusoidal susceptor 510 includes many of the benefits associated with pleated susceptor 10 except that sinusoidal susceptor 510 increases the direct contact between susceptor 510 and food item 100 and is not as compliant for compression or expansion.

Referring to FIG. Six, the susceptor may also take the form of uniform, projections 630 which define both longitudinal and lateral grooves 640. Similarly to pleated susceptor 10, susceptor 610 may include apertures 650 through the susceptor 610. Unlike the pleated susceptor 10 and sinusoidal susceptor 510, susceptor 610 is not compliant for increasing or decreasing the frequency of projections 630.

Food items 100 which can be conveniently browned/crisped by utilizing the susceptor 10, 510, 610 of the present invention include french fries and other potato products, waffles, breaded fish, breaded chicken, breaded vegetables, pastries, egg rolls, etc. which can be placed upon the susceptor 10, 510, 610 in any desired configuration.

The susceptors 10, 510, 610 of the present invention achieve the desired benefits of (i) removing exudate from between susceptor and food item resting thereupon, (ii) increasing the effective surface area of the susceptor in effective thermal communication with a food item resting thereupon so as to enhance the browning/crisping of the food item, and (iii) in preferred embodiments, allowing a single susceptor embodiment to be custom configured at the point of use by simply compressing or expanding the susceptor.

An absorbent pad 710 is preferably configured underneath the susceptor 10, 510 610 for absorbing exudate from food item 100 which passes through susceptor 10. Such absorbent pads 710 are readily commercially available from a number of suppliers including the Minnesota, Mining and Manufacturing Company of Saint Paul, Minnesota, under the trademark MicroInsorb TM.

EXAMPLES

EXAMPLE I

A microwave heater film of metallized polyester available from the Minnesota, Mining and Manufacturing Company of Saint Paul, Minn., under the product code YR-1706, was laminated between (polyester side) 30 pound MG white kraft paper 86200, available from Thilmany Pulp and Paper Company of Kaukauna, Wis., and (metallized side) 25 pound greaseproof paper OG114, available from Nicolet Paper Company of DePere, Wis., by means of a laminating adhesive available from Electromek Company of Carlstad, N.J., under the product code WA-2417A. The adhesive was applied to the kraft paper and greaseproof papers by means of a 20 quad gravure roll. The laminate was pleated with ½ inch faces and 0.25 inch diameter holes were punched at 1 inch intervals into the grooves of the pleated laminate. The holes were centered upon the groove nadirs.

EXAMPLE II

Into a 5.375 inch by 4 inch by 1.375 inch paperboard box commercially employed by Ore-Ida ® to package their microwave crinkle cut potatoes was placed a 5.25 inch by 4 inch MicroInsorb TM pad, available from the Minnesota, Mining and Manufacturing Company of St. Paul, Minn. A pleated susceptor made in accordance with EXAMPLE I, measuring 5.25 inches by 6 inches in a flattened state, was placed into the box on top of the MicroInsorb TM pad.

Two Gorton TM fish patties commercially available in most grocery stores, were placed side by side on the structured susceptor so as to rest upon and be supported by the ridge apexes of the structured susceptor. A second structured susceptor, identical to the first susceptor, was placed over the fish patties such that the groove nadirs contacted and rested upon the fish patties.

The top of the box was opened and fish patties were cooked in a 0.8 cubic foot, 600 watt Litton Meal-In-One microwave oven for 2 minutes, after which time the box was rotated 180° and cooked for another 2 minutes. The fish patties were brown and crisp on the outside while remaining moist and tender on the inside.

EXAMPLE III

Seventy three grams of Ore-Ida® microwave crinkle cut potatoes were cooked in accordance with the procedure of EXAMPLE II, except that the potatoes were cooked for only 1.5 minutes after being rotated 180°. The potatoes were placed transverse to the folds of the susceptor so as to rest upon and be supported by the ridge apexes of the susceptor. The potatoes were brown and crisp on the surface while remaining moist and tender on the inside.

EXAMPLE IV

Seventy three grams of Ore-Ida® microwave crinkle cut potatoes were cooked in accordance with the procedure EXAMPLE III except that the fluted susceptors were replaced with flat 3.75 inch by 5 inch Quik Crisp TM Boards available from the James River Corporation of Neenah, Wis., the MicroInsorb TM pad was removed and the potatoes were cooked for 3.5 minutes prior to being rotated 180° and cooked for another 2 minutes. The resulting cooked potatoes were soggy and saturated with grease.

EXAMPLE V

A structured microwave susceptor was constructed in accordance with the procedure of EXAMPLE I except that both sides of the microwave heater film were laminated to 25 pound greaseproof aper, available from Nicolet Paper Company of DePere, Wis.

EXAMPLE VI

The susceptor of EXAMPLE V was utilized in accordance with the cooking procedure of EXAMPLE III except that a 0.8 cubic foot, 600 watt Sears Kenmore microwave oven was employed and 50 grams Ore-Ida® crinkle cut potatoes were cooked for 3.5 minutes and then rotated 180° and cooked for another 2 minutes. The potatoes were brown and crispy on the outside while remaining moist and tender on the inside.

EXAMPLE VII

Fifty grams of Ore-Ida® crinkle cut potatoes were cooked in accordance with the cooking procedure of EXAMPLE VI except that the potatoes were placed parallel to the folds so as to rest in the grooves of the susceptor. The cooked potatoes were brown and crispy on the outside while remaining moist and tender on the inside.

EXAMPLE VIII

Fifty grams of Ore-Ida® crinkle cut potatoes were cooked in accordance with the cooking procedure of EXAMPLE IV except that a 0.8 cubic foot, 600 watt Sears Kenmore microwave oven was employed, no top susceptor was employed, and the potatoes were cooked at full power for two minutes without rotating the box. The cooked potatoes were generally soggy with slight crispen of the smaller pieces on the side in direct contact with the susceptor.

EXAMPLE IX

A microwave heater film of metallized polyester available from the Minnesota, Mining and Manufacturing Company of Saint Paul, Minn., under the product code YR-1706 was laminated between 25 pound greaseproof paper, available from Nicolet Paper Company of DePere, Wis. by means of a laminating adhesive available from Electromek Company of Carlstad, N.J., under the product code WA-2417A. The adhesive was applied to the paper by means of a 20 quad gravure roll.

Flat susceptors measuring 1" by 1" were cut from the laminate and adhered to the interior base of a six-ounce foamed polystyrene cup using double coated polyethylene foam tape available from the Minnesota, Mining and Manufacturing Company of St. Paul, Minn., under the trademark Scotchmount® and product code Y4484. Accordion and sinusoidal susceptors were also cut from the laminate, the susceptor contracted to occupy a 1" by 1" planar area, and adhered to the interior base of a six ounce foamed polystyrene cup with Scotchmount® Y4484 tape. Accordion and sinusoidal susceptors of varying lengths were cut in order to evaluate the performance of such susceptors with varying distances between ridge apexes. The accordion and sinusoidal shaped susceptors were adhered to the Scotchmount® Y4484 tape at the ridge apexes thereof.

TEST PROCEDURE

After the susceptor and tape combination were adhered to the bottom of the six-ounce polystyrene cup, a 0.10 inch diameter dowel was placed immediately over the susceptor and wedged between the sides of the cup to assure that the susceptor did not float during testing. Fifty grams of modified dimethylsiloxane polymer, available from Dow Corning under the trademark Syltherm® 800, were then placed into the cup over the susceptor.

The cup containing the susceptor and dimethysiloxane was centered in a 0.8 $ft^3$, 600 Watt Sears Kenmore microwave oven and a six-ounce foamed polystyrene cup containing 100 grams of room temperature deionized water was placed at the left rear corner to serve as a load to protect the oven's magnatron. All cups were located precisely within the microwave oven using a foamed polystyrene template to retain the cups.

The initial temperature of the dimethylsiloxane was measured to within 0.1° C. with a thermacouple probe attached to a Fluke Model 52 K-J thermometer, available from the John Fluke Manufacturing Company of Rolling Meadows, Ill. The cups and their contents were then microwaved on full power for one minute. The temperature of the dimethylsiloxane was then measured and the difference ($t_d$) between its initial temperature ($t_i$) and final temperature ($T_f$) was calculated.

CALCULATIONS

The heating ratio of each structured susceptor was calculated in accordance with the formula:

$$\text{Heating Ratio} = \frac{T_{c(structured)}}{T_c(\text{flat})}$$

The heat generating capacity ($T_c$) for each susceptor was calculated by subtracting the initial temperature ($T_i$) and the temperature increase achieved by repeating the procedure without the use of any susceptor ($T_b$) from the final temperature ($T_f$). $T_b$ was experimentally determined to be a constant 2.8 under the present test procedure. Three samples were tested and averaged to obtain the $T_c$.

The results of the various experiments conducted in accordance with the protocol set forth above are set forth in Table 1 below.

TABLE 1

| Susceptr Area (sq. in) | Susceptr Face Size (in.) | Susceptr # Faces | Susceptr Shape | $T_c$ (°C.) | Heating Ratio |
|---|---|---|---|---|---|
| 1 | — | 1 | Flat | 9.1 | 1.00 |
| 1.5 | 0.25 | 6 | Acrdn | 15.0 | 1.65 |
| 2.5 | 0.25 | 10 | Acrdn | 25.9 | 2.85 |
| 2.5 | 0.75 | 3.3 | Acrdn | 29.9 | 3.29 |
| 2.5 | 0.38 | 6 | Snusdl | 28.5 | 3.13 |
| 3.5 | 0.25 | 14 | Acrdn | 28.7 | 3.15 |
| 4.5 | 0.25 | 18 | Acrdn | 36.1 | 3.97 |
| 4.5 | 0.75 | 6 | Acrdn | 48.5 | 5.33 |
| 5.5 | 0.25 | 22 | Acrdn | 34.0 | 3.74 |
| 5.5 | 0.75 | 7.3 | Acrdn | 57.2 | 6.30 |
| 6.5 | 0.25 | 26 | Acrdn | 22.5 | 2.47 |

CONCLUSIONS (i) structuring of a microwave susceptor as set forth in this Example increases the heating ratio of the susceptor for a given planar surface size until the ridge apexes are less than about 0.25 cm apart, at which time the heating ratio levels off; and at a spacing of about 0.10 cm actually begins to decrease. Without intending to be limited thereby, it is believed that the heating ratio begins to slow down and actually decrease due to shadowing of the susceptor surface area by other portions of the susceptor.

(ii) an increase in face size (i.e an increase in the distance between ridge apex and corresponding groove nadir) increases the maximum attainable heating ratio. Without intending to be limited thereby, this is believed to be attributable to the larger faces causing less shadowing for a given susceptor surface area configured on a given planar area.

We claim:

1. A microwave susceptor comprising a sheet of microwave interactive material adapted for converting microwave energy to heat, said sheet having a multiplicity of alternating substantially parallel ridge apexes and groove nadirs, said ridge apexes adapted for supporting a food item thereon, said sheet adapted for increasing and decreasing the linear distance between sequential ridge apexes by compressing or expanding the pleated sheet.

2. A microwavable container for food comprising:

a) a microwave transparent material defining a chamber;

b) a microwave susceptor retained within said chamber which comprises a substantially uniformly pleated sheet of microwave interactive material adapted for converting microwave energy to heat and having a plurality of substantially parallel linear ridge apexes, said sheet adapted to concentrate the heat generation capacity of the susceptor when said pleated sheet is compressed, and to dissipate the heat generation capacity of the susceptor when said pleated sheet is expanded, and c) a food item retained within the chamber and supported by the ridge apexes of the microwave susceptor.

3. A microwave susceptor comprising a substantially uniformly pleated sheet of microwave interactive material adapted for converting microwave energy to heat and for supporting a food item thereon, said sheet generally adapted to concentrate the heat generation capacity of the susceptor when said pleated sheet is compressed and to dissipate the heat generation capacity of the susceptor when said pleated sheet is expanded.

* * * * *